United States Patent [19]

Woodward

[11] 4,183,766

[45] Jan. 15, 1980

[54] PAPER COATING COMPOSITION

[76] Inventor: Fred E. Woodward, 200 Churchill Rd., West Palm Beach, Fla. 33405

[21] Appl. No.: 910,001

[22] Filed: Jun. 12, 1978

[51] Int. Cl.[2] ..... C08L 3/02; C08L 29/02

[52] U.S. Cl. ..... 106/213; 106/287.23; 260/29.6 MP; 260/29.6 AB; 260/29.6 B; 260/29.7 R

[58] Field of Search ..... 106/210, 213, 308 Q, 106/177, 287.23; 162/158, 181 D; 260/920, 29.6 MP, 29.6 AB, 29.6 B, 29.7

[56] References Cited

U.S. PATENT DOCUMENTS

| | | | |
|---|---|---|---|
| 2,886,546 | 5/1959 | Dibert et al. | 260/17 R |
| 3,346,487 | 10/1967 | Irani et al. | 106/308 Q |
| 3,399,144 | 8/1968 | Hathaway et al. | 252/49.8 |
| 3,736,164 | 5/1973 | Uffner | 106/213 |

*Primary Examiner*—Theodore Morris

[57] ABSTRACT

Theeffectiveness of pigment coatings compositions for printing paper stock is enhanced by the use of phosphate esters of aliphatic alcohols and/or their salts therein.

13 Claims, No Drawings

PAPER COATING COMPOSITION

The subject invention relates to the art of improving the finish of printing paper stock by the application of coating compositions which comprise basically a mixture of a pigment, a binder, and additives for enhancing certain properties of the coating which may include one or more agents; such as, antistatic agents, coloring agents, coating holdout agents, defoaming and antifoaming agents, dry pick agents, gloss agents, plasticizing, leveling and evening agents, preservative agents, pigment dispersants, rewetting agents, scuff and abrasion resistance agents, vehicle holdout agents, viscosity modifying agents, wetpick and web rub agents or combinations thereof.

It is the principle object of this invention to provide novel paper coating compositions containing a gloss-improving agent which affects the surface and interfacial tensions of the coatings and improves the flow properties and smoothness in the wet state and enhances the plasticity and lubricity of the dried film. The gloss improver, prevents sticking and picking of the coating during drying and finishing and reduces the tendency of the dry coating to block or dust. The finished sheet shows higher gloss, improved smoothness, diminished mottle, improved ink receptivity, decreased pattern, improved fold characteristics and improved print quality.

A further object of the invention is to provide an inexpensive alternate to the present use of stearic acid soaps for paper coating lubricants. Animal fat derived stearate soaps are in short supply and animal fat could be better utilized as a food source than for industrial application.

In accordance with this invention certain novel phosphate esters, as hereinafter described, are added in relatively small amounts to an otherwise conventional paper coating color (pigment containing paper coating composition.) The coating color compositions of this invention consist essentially of water, pigment, and adhesive and certain phosphate ester salts as hereinafter described. However, it will be understood that other materials and additives such as those hereinafter mentioned, commonly used in paper coating colors, may be used and are included within the scope of the coating color compositions according to the present invention.

It has been found that paper coating colors formulated with the phosphate esters of the present invention result in a coated sheet having printing qualities, namely reduced mottle, continuity of ink surface, reduced pattern and clarity of printing superior to a coated sheet containing no such phosphate ester. The coating color formulated in accordance with this invention is an aqueous dispersion which results in an improved leveling index. Furthermore, the gloss of the coated sheet is higher permitting the coated sheet to be calendered less severely than would normally be possible without the inclusion of the phosphate ester.

It is not intended that this invention be bound to any theory as to the reasons for the unexpected beneficial results obtained by the inclusion of the phosphate esters in coating color compositions. Considerable data is available concerning the effects of polyglycol esters, sulphated esters, stearate soaps, polyamine soaps, etc., on coating colors and coated sheets. It is well known that surface chemistry has a significant influence on the behavior of paper coatings through change of the surface and interfacial forces present in the coatings. Viscosity, flow and leveling, penetration and adhesion are a few of the coating color properties that can be affected by the surface and interfacial energies of coatings. In the preparation and application of paper coating colors the properties at the interface of the solid (pigment) and liquid (water) are of major importance. An interface is the submicroscopically thin region between two immiscible liquids or a solid and a liquid. It is an area of discontinuity, the properties of which differ markedly from the two phases. Paper coatings are primarily concerned with the solid-liquid system although the gas (air)-liquid interface is also of importance because of its effect on the flow, leveling and pattern properties of the applied coating.

We have now found that phosphate esters of this invention alter the surface and interfacial properties of liquids to an unusual degree even when these chemicals are present in small quantities, as manifested by energy changes in surface and interfacial tensions. As a result they affect the dispersion of the coating ingredients, modify the rheological properties and afford a greater degree of control over the penetration and adhesiveness of the coating, thereby imparting properties to the coated sheet unobtainable without the addition of such phosphate esters.

According to this invention the effectiveness of existing paper coating compositions is greatly enhanced by the inclusion therein of certain aliphatic phosphate esters. These esters comprise the phosphate esters of aliphatic alcohols having a carbon atom content of 6–26. Aliphatic alcohols having 16–26 carbon atoms are particularly advantageous for preparing the esters for the purposes of this invention. A mixture of alcohols of varying chain length may be used and, in fact, the usual, available commercial sources of raw materials will constitute such mixtures.

Alcohols that are highly effective for the purpose of this invention include those produced by the oxo process from mono-olefinic straight chain hydrocarbons (as exemplified by the commercial products of Shell Chemical Co., sold as Neodols). These products have random chain lengths. The process may be optimized around any carbon length but in commercial practice today a range from $C_{12}$ to $C_{15}$ alcohols are produced which have 20% branched (methyl) chain primary alcohols; the remainder being straight chain primary.

Alternatively, suitable alcohols may be produced by telemorization of ethylene with a Ziegler-type aluminum catalyst and with subsequent decomposition to fatty alcohols. Alcohols with even carbon numbers are produced by this process (from $C_4$ to $C_{26}$) all straight chain and primary. The products are separated by distillation into nearly pure even carbon alcohol products or a mixture of 2 or 3 contiguous products. Preferred alcohols from this process, when converted into a phosphate ester, are the mixtures of $C_{16}$, $C_{18}$, $C_{20}$, and $C_{22}$ alcohols, or the same alcohols is essentially pure form.

Another product suitable for use are the phosphate esters of aliphatic alcohols containing up to 45% hydrocarbons of substantially the same boiling point. Such phosphate esters may be formed, for example, from the residue (distilled) from the distillation of the fatty alcohols from the decomposed telemorization reaction which leaves a mixture of $C_{20}$ and higher fatty alcohols mixed with up to 45% of normal paraffins with boiling points essentially equal to the $C_{20}$ to $C_{26}$ fatty alcohols.

Fatty alcohols produced by the catalytic reduction of naturally occurring fatty acid methyl esters by hydrogen are also suitable and desirable for conversion to phosphate esters for use in this invention.

The phosphate esters of alcohols produced by the standard oxo reaction from branched olefins also make suitable products as paper coating gloss improvers. These alcohols are normally, in commercial practice, fractionated to essentially single carbon number alcohols and useful ones range from $C_6$ to $C_{13}$. Higher carbon number alcohols of this type are also useful, but are not readily available commercially.

The phosphate esters may be prepared by reacting an aliphatic alcohol, such as those referred to above, with an oxy acid of pentavalent phosphorous, such as orthophophoric acid, pyrophosphoric acid, polyphosphoric acid, phosphorous pentoxide or mixture of these. The reaction may be illustrated by the following equation:

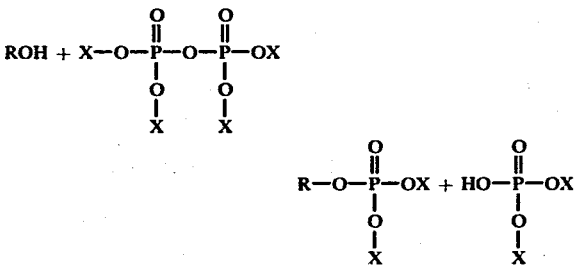

Where X is H or

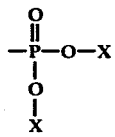

And R is an alkyl of 6 to 26 carbon atoms.

This is a schematic over simplification of the reaction which proceeds after the initial esterification-solubilization step as a complex series of ester interchange reactions to give that mixture of esters and acids which is most stable. The exact mixture is a function of the solvent properties of the alcohol (ratio of alkyl chain length to OH) and of the degree of dehydration of the phosphoric acid-phosphoric anhydride composition.

The latter may be represented schematically by the following:

$$(H_2O)_3.P_2O_5 \rightarrow (H_2O)_{3-n}.P_2O_5 + H_2O \uparrow$$

When n=o, product is $H_3PO_4$ n=1.0, product is metaphosphoric acid n=3, product is phosphoric anhydide n=2.8, product is 115% polyphosphoric acid In general the reaction is carried out by mixing the acid and alcohol while heating at 70° C. to 125° C. The reaction proceeds to completion within one half to three hours. The esters thus formed provide additives which when incorporated in pigment containing paper coatings significantly enhance the functional properties thereof particularly with respect to improvement in the gloss and non-dusting properties of the coated paper.

Advantageously, the esters may be employed as salts, particularly the esters of the longer chain alcohols having $C_{16}$ and higher chain length. This is related to the fact that the phosphate ester additives, in accordance with the present invention, are advantageously prepared in liquid form, to facilitate handling and admixture in paper coating formulations, and preferably in the form of a concentrated aqueous dispersion at concentrations of from 30% to 55%, by weight.

The phosphate esters of $C_6$ to $C_{16}$ alcohols are liquids in their anhydrous acid form and may be added in that form to the various paper coating formulations that are suitable for "printability" coatings. These mixed with higher alcohol phosphates such as the $C_{12}$ to $C_{14}$ alcohol phosphates, and especially with higher branched alcohol phosphates, such as, tridecyl alcohol made from propylene tetramer, are also low enough in melting point to be shipped as anhydrous liquids. They may also be neutralized with ammonia or bases of alkali metals, such as potassium or sodium hydroxide, to give reasonably concentrated solutions or slurries in water of 30 to 60%.

The straight chain $C_{16}$, $C_{18}$, $C_{20}$ and higher alcohol phosphates and their mixtures, however, are high in melting point and difficult to dissolve, disperse, or emulsify suitably for the paper-coating industry as anhydrous liquids. If neutralized in water as the sodium, potassium, or ammoniun salts, they tend to be too "insoluble" in water, and at reasonable concentrations of 20–50% form stiff pastes in water.

We have found, however, that if such higher alcohol ($C_{16}$ and higher) phosphate esters are dispersed with the aid of an additional wetting agent, dispersing agent or emulsifier that high solids "dispersions" (40–55% solids in water) of these higher alcohol phosphate esters may be made. Further, we have found that in addition to neutralization with sodium, potassium or ammonium hydroxides, they may be neutralized with calcium hydroxide or magnesium hydroxide (the former is preferred) while still forming fluid pumpable dispersions of 40–55% solid concentrations. Normally, only 3 to 10% (on a solids basis) of such a dispersing agent is required, although less or considerably more may be necessary or desirable in some cases. Non-ionic surfactants which contain (on a weight basis) an average of about 60 to 85% ethylene oxy units are preferred, but other non-ionic surfactants are suitable and preferrably those which are good "lime soap dispersing agents". According to the method of Borghetty and Berman, this is measured by the: grams of dispersing agent × 100 required to disperse sodium oleate in 340 ppm hard water/weight of sodium oleate; the lower the better. An index of 10 or lower is preferred. Many non-ionic surfactants are also suitable as would be recognized by those skilled in the art.

Examples of products which are suitable particularly for stabilizing the alkaline earth salts of this invention but which may also be beneficially used in other salts of this invention are:

- sodium stearoyl-N-methyl taurate (and oleyl, lauroyl, etc)
- sodium lauroyl isenthionate
- lauryl alcohol + 7 moles ethylene oxide
- $C_{11-15}$ straight chain alcohol ethoxylated with 60% by weight ethylene oxide
- Nonyl-phenol + 9 moles ethylene oxide
- Oleic acid + 15 moles of ethylene oxide
- polypropylene oxide (MW 600) + 40% ethylene oxide (by weight).

Many other appropriate surfactants will be apparent to those skilled in the art. Although the use of surfactants in this patent is normally best at low levels of the most efficient product there is included within the scope of this invention the use of mixtures of high levels of less efficient emmulsifying dispersing agents. In fact, it is possible to use a mixture of a hydrophobic phosphate ester and a hydrophylic phosphate ester such that the resulting mixture is readily dispersible by one or more of the techniques taught herein.

Thus we are limited only to amphipath combinations in which the phosphate ester is more than 50% by weight of the total amphipath added to the coating composition.

The phosphate ester salts of the invention may be readily prepared by adding the molten phosphate ester to an acqeous solution or dispersion of a metal hydroxide such as those referred to above. In the case of esters derived from $C_{16}$ alcohols the neutralizing salt such as the alkaline earth metal hydroxides mentioned above is advantageously employed in acqeous mixture with one or more of the emulsifying agents described above. Various alternative methods may be used as will be readily apparent to those skilled in the art. For example, in preparing a dispersion of an alkaline earth metal salt of a $C_{16}$ or higher phosphate ester, a water soluble emulsifying agent may be added to the molten ester and a water dispersion of the neutralizing salt then added to the molten ester. The amount of the neutralizing salt added is based on the acid number of the phosphate ester (mg. of KOH needed to neutralize 1 g of the ester to a pH of 10).

As a further step in the process of producing such high solids products it is sometimes necessary or desirable to subject the dispersions to a high shear action such that the particles are all reduced to a uniform small size and thus free of "grit" and capable of passing through a 200 mesh screen with no more than 0.5% of the solids remaining on the screen.

There are various high shear devices which are suitable. Among them may be mentioned the CP model "Multi-Flo" homogenizer manufactured by the CP division of St. Regis, in Lake Mills, Wisconsin; and Faulin Corporation's homogenizer. These mills typically operate by pumping the dispersion through a spring-loaded valve at pressure drops from 1,000 psi up to 10,000 psi. Other homogenizers which operate at less drastic shear rates may be suitable, such as Scvarig's "Attriter" mill, the Jones (Division of Beloit Corporation) Model HP "Hi-Intensity" mill; the "Kady" mill of Kinetic Dispersion Corporation.

As pigments may be used, all those commonly used clays which constitute the major class of opaque material used in printability paper coatings. These are naturally-occuring materials refined to a high degree of whiteness or brightness by removing traces of colored impurities. Other pigments used are calcium carbonate and titanium dioxide. The latter is commonly added in relatively small amounts to a clay-based coating to improve whiteness. For a detailed discussion of paper coating pigments see:

Pulp and Paper Science and Technology, Vol. II Paper, Ed. By C. E. Libby, McGraw Hill, 1962.

An additional class of pigments are the small particle organic polymer latices such as polystyrene and exemplified by Monsanto's RX-1259.

A particularly advantageous method of applying the concepts of this invention is the preparation of a dispersion of pigment and the dispersed amphipaths of this invention in a high shear device before addition to the coating binder and the remaining coating pigment if any. By "high shear device" is meant any of the homoginizers described herein. Although it will be readily apparent to those skilled in the art that many devices besides those mentioned would be appropriate. It is necessary only to apply that amount of agitation, work, or shear to a mixture of the gloss improver and pigment so that the pigment is completely coated with the amphipath while at the same time the coated pigment remains dispersed in water.

Many products have been developed over the years for use as binders in pigmented paper coatings. One of the oldest and still most widely used is starch. The starch has to be "boiled" or heat treated to get it solubilized in water. In recent years it has become common practice to use pre-oxidized starch or to treat the starch with an enzyme or chlorine in the process of preparing the paper coating.

The starches are frequently used as the sole binder.

Another type of binder in wide use are the styrene-butadiene latices as exemplified by Dow's 620 latex. In more recent versions of the styrene-butadiene latices a carboxylated monomer is introduced at low percentages into the polymer during polymerization.

A leveling agent or secondary binder is usually used with the styrene-butadiene type latex binders, such as casein, soy protein, naturally occuring gums, polyvinyl alcohol and low molecular weight carboxylated synthetic polymers. The ratios of these secondary binders to the primary styrene butadiene latex binder vary widely and becomes critical only if very specific effects are desired.

Further examples of pigment binders are the modern carboxylated polyvinyl acetate latices. There are normally terpolymers made by polymerizing vinyl acetate, an alkyl acrylate, and a carboxylated monomer such as acrylic acid itaconic acid, maleic anhydride, etc. These latices may be used as the sole binder. Polyacrylate latices are also used.

The type of binder and pibment and the ratio of binder to pigment are not critical to this invention and one skilled in the art of formulating printability coatings will recognize the value of the gloss improvers of this invention in improving the rheological properties and the stability of paper coating formulations and of the improved ease of applying the coating and the improved gloss of the final calendered sheet. In general, paper coating formulations are prepared in accordance with well-known procedures. Thus, 100 parts of the pigment is dispersed in water with any of the well known dispersing agents. The amount of water depending on the final solids level desired for the coating. This may vary from 10% to 65% or even higher. Then from 5 to 35 parts of binder (solids) per 100 parts of pigment are added, followed by from 0.3 to 5 parts per 100 parts of pigment of the products of this invention but higher levels can be used. The final coating is then mixed with a high shear mixer, and in some cases filtered to remove any grit or contamination. It is also possible to prepare the coating formulation in a continuous mixer.

The methods of effectively applying such coatings to paper are also well-known to those skilled in the art.

The invention and effective means for carrying it out in accordance with the objectives thereof are illustrated by the following examples:

EXAMPLE 1

The phosphate ester (90.0g.) of Epal 1418, a mixture of primary, straight chain, alcohols with the composition

| | |
|---|---|
| $C_{14}$: | 35.9% |
| $C_{16}$: | 38.8% |
| $C_{18}$: | 23.8% |
| $C_{20}$: | 1.5% |

is made by heating together 275 g. of Eapl 1418 alcohol, 121 g. polyphosphoric acid and 1.5 g. hypophosphorous acid to 110° C., with stirring for 1 hour. The product is cooled to 60° C. and added while still molten to 59.9 g. calcium hydroxide dispersed in 300 ml. water and 6 g. of Neodol 25-9. . *The emulsion or dispersion is then diluted further with 100 ml. of water and passed three times through a Logeman homogenizer. The final pH was 11.0; the solids content was 20.4%.

*A mixed $C_{12}$-$C_{15}$ alcohol of which about 80% is straight chain, ethoxylated with 9 moles of ethylene oxide, manufactured by Shell Chemical Company.

The above gloss additive was added at a level of 2 pts. (solids basis) to a paper coating formulation composed of:

100 pts. KCS clay
0.25 pts. tetra sodium pyrophosphate
0.1 pts. NaOH dispersed at 70% solids
20 pts. oxidized starch (AE Staley's Stayco M)

EXAMPLE 2

To 525 g. of Neodol 45 (a $C_{14}$-$C_{15}$ alcohol prepared by the oxo reactions on a $C_{13}$ straight chain α-olefin) heated to 62° C., was added 6 g. lypophosphorous acid 50% and 308 g. of polyphosphoric acid 115%, preheated to 55° C. The mixture was then heated to 100°-105° C. for 2½ hours and then allowed to cool.

The phosphate ester was converted to a dispersion of the calcium salt by admixing the following materials according to the procedure of Example 1:

67.8 g. of the above
22.6 g. $Ca(OH)_2$
3.8 g. Neodol 25-9
277.0 g. water
Solids are 22.6% and pH 10.6

The above additive was added at a level of 2 pts. (solid basis) to a paper coating formulation as in Example 1.

EXAMPLE 3

Neodol 25 (OH No. 270, an oxo alcohol from Shell Chemical Co, made from an olefin of $C_{11}$ to $C_{14}$ straight chain α olefin), 15.0 g. was added to 0.5 g. hypophosphorous acid 50% and 92.5 g. polyphosphoric acid 115% heated to 75° C.; heated to 105° C. and held for 5 hours; then cooled. Eighty-five g. of this product was then heated to 80° C. and added to 31.6 g. ($Ca(OH)_2$ (calculated from the acid number as the theoretical amount required for neutralization), 251.4 g water, and 4.0 g. Neodol 25-9. The dispersion was homogenized and the pH adjusted with 4.6 g. Ca $OH_2$ to 12.). The final composition was:

18.1% Phosphate ester
6.2% Calcium hydroxide
3.9% Neodol 25-9
74.3% water

This was mixed with the paper coating formulation, Example 1, at a level of 2 pts. (solid basis).

EXAMPLE 4

In the same manner a dispersion of the calcium salt of a phosphate ester (prepared from a mixture of 75 pts. of Epal 108 which has the composition): (all straight chain primary alcohols):

| | |
|---|---|
| $C_6$ | 4% |
| $C_8$ | 55% |
| $C_{10}$ | 40.5% |
| $C_{12}$ | 0.5% |

and 75 pts. Neodol 25 (by 115 parts of a 115% reaction with polyphosphoric acid) was made with a final composition of:

21.9% Phosphate ester
16.9% calcium hydroxide
3.33% Neodol 25-9
67.0% water

The above additive was added at a level of 2 pts (solid basis) to a paper coating formulation of Example 1.

EXAMPLE 5

In a similar manner the phosphate ester of decyl alcohol (Exxon Chemical—an oxo alcohol from a branced olefin) and $P_2O_5$ acid was converted to the calcium salt in a dispersion form with the composition:

23.2% Decyl alcohol phosphate ester
14.7% calcium hydroxide
1.54% Neodol 25-9
60.56% water and added (2 pts, solid basis) to the paper coating formulation of Example I.

EXAMPLE 6

The phosphate ester (36 pts) of Epal C20 prepared from 31.7 parts of Epal C20 + and 4.3 parts of Polyphosphoric acid was mixed with 4.0 pts of Di Acid (Westvaco 1550) (acrylic acid aduct with linoleic acid) and 1.6 pts of Neodol 23-6.5 heated to 55° C. and to it was added a dispersion of 8.5 pts of calcium hydroxide in 60.0 pts of water. After two passes through the laboratory (C. W. Logeman) homogenizer it was a smooth thin dispersion with a pH of 11.5-41.8% solids.

The phosphate ester salt dispersion thus obtained was added (2 pts. solid basis) to a paper coating formulation of Example 1.

EXAMPLE 7

The phosphate ester of essentially pure lauryl alcohol was prepared from 98.4 g. of Alfol 12 (Conoco-Chemicals) and 51.4 g. of polyphosphoric acid and neutralized with potassium hydroxide, as a 27% solution, following the above procedures. Such solution was added to a paper coating composition of Example I. (2% on the weight of the pigment)

EXAMPLE 8

The phosphate ester of Conoco's Alfol C20+ which is a mixture of primary $C_{20-28}$ linear alcohols with the following distribution:

| | |
|---|---|
| $C_{18}$ and lower | 2% |
| $C_{20}$ | 60% |
| $C_{22}$ | 20% |

-continued

| | |
|---|---|
| $C_{24}$ | 10% |
| $C_{26}$ | 5% |
| $C_{28}$ and higher | 3% |
| Hydroxyl No. | 123 |
| Total Alcohol Content | 67% |

Remainder is essentially normal paraffin and olefins.

was prepared by the method of the above examples using a ratio of 84 parts of the $C_{20}$ alcohol to 16 parts of polyphosphoric acid. The resulting ester while still molten was poured into a dispersion of calcium hydroxide in water as in Example I; and homogenized to a smooth fluid dispersion.

The phosphoric ester salt dispersion was then added to a paper coating composition of Example I at a level of 2 parts solids basis per 100 parts of pigment.

EXAMPLE 9

A typical coating formulation utilizing a commercial calcium stearate dispersion (50% solids) as an additive for enhancement of paper surface and printing characteristics for purposes of comparison was prepared by adding 2 parts calcium stearate (solids basis) to a water composition corresponding to that in Example I per 100 parts of clay.

EXAMPLE 10

Similarly, the coating composition of Example I without addition of the phosphate esters of the present invention or use of additions such as calcium stearate was prepared for application to a paper surface.

The coating compositions obtained as described in the above examples were applied in a conventional manner to a paper surface by means of a Meyer Rod (No. 40). Then coatings were dried and then calendered—2 mps at 500 pli. The following Table I illustrates the comparative results obtained on the respective coated papers:

Table I

| Gloss Improver | pH | Viscosity @100 RPM (Brookfield) | Solids | Casting Weight (lbs/3,300 ft.) | Gloss 75° Gardner | Brightness GE |
|---|---|---|---|---|---|---|
| (1) Ex. 1 | 6.95 | 734 cps | 53.1% | 4.67 | 53.9 | 66.3 |
| (2) Ex. 2 | 6.85 | 736 | 53.1 | 5.43 | 58.2 | 68.1 |
| (3) Ex. 3 | 6.85 | 754 | 53.1 | 6.18 | 62.7 | 68.3 |
| (4) Ex. 4 | 6.85 | 768 | 52.7 | 6.43 | 62.3 | 68.4 |
| (5) Ex. 5 | 7.40 | 864 | 53.3 | 6.53 | 63.4 | 68.0 |
| (6) Ex. 6 | 7.00 | 754 | 53.1 | 6.58 | 67.0 | 68.3 |
| (7) Ex. 7 | 8.40 | 1520 | 52.7 | 6.9 | 64.8 | 68.7 |
| (8) Ex. 8 | 7.05 | 848 | 53.5 | 6.51 | 63.5 | 67.1 |
| (9) Calcium Stearate | 6.85 | 1192 | 53.3 | 6.12 | 61.9 | 66.8 |
| (10) No Additive | 6.80 | 706 | 53.9 | 4.56 | 60.9 | 65.7 |

It is a principal purpose in coating paper to improve the gloss and writing quality of the paper without decreasing the brightness of the paper. By plotting Gloss vs Coatin Weight for each of the examples from Table I, the resulting graph illustrates that as the coating weight is increased (regardless of what additive is used) the gloss improves. However, a graph of GE Brightness vs Coating Weight shows that as coating weight is increased to obtain a higher quality paper, the brightness of the sheet is a distinct function of the additive. All of the examples of the products of this invention are better than the examples employing calcium stearate or no additive.

In a plot of incremental improvement in GE Brightness vs Coating Weight, from the data in Table I above, the higher the ratio the greater the benefit obtained from the coating additive, as shown in the following table:

Table II

| | ΔGE Brightness | ΔGE Brightness/ Coating Weight |
|---|---|---|
| Example 1 | .6 | .12 |
| Example 2 | 2.4 | .44 |
| Example 3 | 2.6 | .42 |
| Example 4 | 2.7 | .42 |
| Example 5 | 2.3 | .35 |
| Example 6 | 2.6 | .40 |
| Example 7 | 3.0 | .43 |
| Example 8 | 1.4 | .22 |
| Calcium stearate | 1.1 | .18 |
| No additive | 0 | .00 |

Thus, all of the examples except No. 1 were better than calcium stearate in this series of tests.

EXAMPLE 11

In this example an additive was prepared by combining two gloss improver preparations as follows:

(A) 75.1 parts of the phosphate ester of Epal 20 (Ethyl Corp.) Eicosonal—paraffin wax mixture prepared with 19.7% polyphosphoric acid, was melted and poured into 17.5 parts of 30% ammonia in 107.5 parts of water with vigorous stirring while cooling to 30° C.

(B) 350 parts of the phosphate ester of decyl alcohol (Exxon oxo alcohol) was prepared and converted to its ammonium salt by adding with stirring and cooling to a solution of 166.5 parts 33% ammonia in 483.5 parts water.

150 parts of (A) above and 30 parts of (B) were mixed to form a gloss improver additive which was added to a coating formulation in a laboratory high-shear mill, to give the following composition:

| As is Basis | Dry Basis | |
|---|---|---|
| 100g | 100g | Hydra Gloss 90 (a high brightner clay from J. M. Huber) |
| 4g | 2g | Protein--soluble |
| 35g | 14g | Ucar 40--(a styrene (40%)2-ethyhexyl-acrylate (60%) co-polymer (Union Carbide) binder |
| 0.4g | 0.1g | Tamol 850 (a dispersing agent) |
| 2.7g | 1g | gloss improver formulation prepared as above |
| 93g | | water |

-continued

| As is Basis | Dry Basis |
|---|---|
| 235.1 | 117.1 |

In addition, further coating formulations based upon the above Ex. 11 were prepared as follows:

Ex. 11a—Same as above but substituting Dow 620 latex (styrene-butadiene latex) for the Ucar 40 binder)

Ex. 11b—Same, but substituting calcium stearate in place of the gloss improver additive of Ex. 11

Ex. 11c—Same, but with no gloss improver additive

Ex. 11d—Same as 11a above but with no gloss improver additive.

The above coatings applied at 8 lbs per ream were calendered on a super calender 4 nips at 600 lb/linear inch. The coated paper gave the following results.

| Ex. | Binder | Additive | Gloss 75° | Brightness (G.E.) |
|---|---|---|---|---|
| 11 | Ucar 40 | Ex. 11 | 79.3 | 76.5 |
| 11a | Dow 620 | Ex. 11 | 76 | 78.5 |
| 11b | Ucar 40 | Calcium stearate | 74.2 | 77.5 |
| 11c | Ucar 40 | None | 74.8 | 77.4 |
| 11d | Dow 620 | None | 69.7 | 77.6 |

The above coating formulations were aged for three weeks and then were again applied as coatings as described above. The formulations of Examples 11b and 11d above had set up as pastes and were not satisfactory for use. The remaining formulations when applied yielded the following results:

| Example (Aged 3 wks) | Gloss 75° | Brightness (G.E.) |
|---|---|---|
| 11 | 75.5 | 77.0 |
| 11a | 77.5 | 77.5 |
| 11c | 74.2 | 77.5 |

The above illustrates that the additives of this invention have equal or superior stabilizing effects on paper coating formulations.

EXAMPLE 12

In this example a series of gloss improver preparations, prepared as described hereinafter, were added to a paper coating formulation as follows:

| As is Basis | Solids Basis | |
|---|---|---|
| 143 pts | 100 pts | No. 2 coating clay (J. M. Huber Hydrosperse) |
| 100 pts | 13 pts | Casein (Borden PCG) predissolved by mixing into 2.60 pts 30% ammonia and 84.4 pts water |
| 15.5 pts | 7 pts | Dow 620 latex |
| | 0.1 pts | Dowicide 9 |
| | | water |
| | 2 pts | Gloss improves as hereinafter described |

The gloss improver additives were prepared as follows:

(a) The phosphate ester of Epal C20- was prepared by heating together 435 g Epal C20-, 65 g polyphosphoric acid 115%, and 4 g hypophosphorous acid 50% with stirring to 115° C. for 1 hour; then cooling to room temperature.

(b) A phosphate ester was prepared as in the previous example from 750 g hexyl alcohol (Exxon, branched chain oxo alcohol) and 935 g polyphosphoric acid and cooled to room temperature.

(c) The phosphate ester from 334 g decyl alcohol (Exxon) and 226 g polyphosphoric acid (115%) was prepared as hereinelsewhere described (see Ex. 5) 52.3 g. of such ester was removed and while still liquid added to a dispersion of 23.8 g of calcium hydroxide and 4 g of Neodol 25-9 in 84.2 g of water (42.1% solids).

(d) The phosphate ester from 528 g Epal 14 an essentially pure tetradecyl alcohol, and 308 g polyphosphoric acid was neutralized with 45% KOH to give a 16.3% solution (on free acid basis).

(e) A phosphate ester was prepared as in (d) above except using an essentially pure lauryl alcohol, and neutralized to give 13.8% solution (on a free acid basis).

(f) A phosphate ester additive preparation was made comprising a 35% solution of the ammonium salt of the phosphate ester of Exxon decyl alcohol.

The coatings prepared by adding the gloss improvers to the coating formulation of this example were each coated on a 8½×11 sheet of 36 lb/ream base coating stock and then calendered on a Perkins laboratory super calender, 4 nips at 600 pli. The sheets were then evaluated with the following results:

| Gloss Improver in Coating | Lbs. of Gloss Imp/ 100 lbs of Clay | 75° Gloss | G. E. Brightness |
|---|---|---|---|
| 12 (a) | 14.7 | 46.8 | 76.5 |
| (b) | 2.0 | 40.3 | 76.5 |
| (c) | 2.0 | 36 | 76.8 |
| (d) | 2.0 | 41.7 | 69.7 |
| (e) | 2.0 | 42.8 | 69.7 |
| (f) | 2.0 | 40.6 | 70.9 |
| None | None | 35.9 | 75.7 |

EXAMPLE 13

This example illustrates a fluid dispersion in water can be made of the calcium salt of a phosphate ester of a C20 fatty alcohol. In a wide ranging series of experiments with the sodium ammonium, & potassium salts of this phosphate ester with a wide variety of emulsifiers, only a maximum of a 25% dispersion in water could be obtained. However, when the phosphate ester was neutralized with calcium hydroxide in the presence of an emulsifying agent which was otherwise a good lime soap dispersing agent it was possible to obtain a dispersion in water which remained thin and fluid with a viscosity of less than 600 cps. Thus to mixtures of:

1823 gm of a C20 alcohol (Continental Oil Co.'s Alfol C 20)

14.6 gm. Hypophosphorous acid 50%

447.3 g Polyphosphoric Acid (115%)

was mixed at 80° C. and heated to 110° C. for one hour. Then 1000 g of the molten ester was dispersed into 180 g. Hydrated lime 70 g Neodal 25-9 (Shell Oil Co.) (a nine mole ethoxylate of an essentially linear alcohol)

1710 g water

The dispersion was further refined by grinding it for 5 minutes in a Waring Blender and then passing it 2 times through an homogenizer. The preferred homogenizer being a Manton-Gaulin colloid mill running at 4000 psi pressure drop.

According to a further feature of this invention, if the gloss improver (phosphate ester or its salt) is pre-mixed with a paper coating pigment—which may or may not be the same pigment used in the final coating formulations and this mixture of gloss improver and pigment subjected to the action of a high shear device—an improved additive results which when added to a paper coating formulation in the usual way, greatly enhances its coating properties. The benefits of this feature of the invention are also apparent when equal levels of gloss are obtained at lower levels of the gloss improver (the phosphate esters or their salts, aliphatic alcohols with carbon numbers of $C_6$ to $C_{26}$). According to this feature of the invention the phosphate esters or their salts as discribed herein may advantageously be added in amount of 10 to 90% by weight of the pigment. Approximatly equal proportions are most effective.

Such premixed gloss improver is advantageously prepared as an aqueous dispersion comprising from about 25 to 55% solids.

EXAMPLE 14

This example further illustrates the phosphate esters advantageously mixed with small particle pigments and prehomogenized before making the addition to the paper coating formulation.

A mixture of 20 parts (solids basis) of Monsanto's plastic paper coating pigment RX-1259 (40% solids) and 80 parts (solids basis) of the calcium salt of the phosphate ester of a crude $C_{20}$ alcohol as prepared in Example 13 at 39% solids was diluted to 20% solids and passed through a laboratory (C.W. Lodgeman) homogenizer.

The resulting dispersion was added to a paper coating formulation at a level of 1.68 parts mixed additive (solids basis) per 100 parts of clay. The coating formulation used was made up as follows:

| Parts Solids Basis | Parts As is Basis | |
|---|---|---|
| 42 | 93.5 | Polyvinyl acetate latex (National Starch's 25-1105) |
| 210 | 300 | Paper coating clay #2 (J. M. Huber's Hydrosperse) |
| 1.68 | 8.38 | Additive |
| | 252 | Water |

The coating formulations were mixed in a laboratory high shear mixer (Waring-Blender) for 10 seconds to simulate the action of a Kady mill as used in full scale production.

A coating formulation of the above proportions was made up with each additive listed below and a typical coating base stock—38 pounds basis weight—was coated, one series with a No. 18 Meyer rod, and the other with a No. 40 Meyer rod. The coated sheets were calendered 3 nips at 750 pli.

| | Additive | Prehomogenized | Gloss #18 | Gloss #40 | Gloss Total |
|---|---|---|---|---|---|
| A. | 20% Monsanto RX-1259<br>80% Example 13 (as is basis) | yes | 58.9 | 63.2 | 122.1 |
| B. | 20% HiSil 233 (PPG Industries precipitated silica)<br>80% Example 13 (as is basis) | yes | 52.8 | 65.1 | 117.9 |
| C. | 20% Zeothix 95 (J. M. Huber's precipitated silica)<br>80% Example 13 (as is basis) | yes | 53.4 | 62.0 | 115.4 |
| D. | 20% Titanium Dioxide (Glidden's Zopaque R-773)<br>80% Example 13 (as is basis) | yes | 54.1 | 62.2 | 116.3 |
| E. | 20% Titanium Dioxide (Glidden's Zopaque R-773)<br>80% Example 13 | no | 57.9 | 59.8 | 117.7 |
| F. | 20% Zephix 95 (J.M. Huber's precipitated silica)<br>80% Example 13 | no | 43.8 | 63.0 | 106.8 |
| 1. | Example 13 | — | 53.0 | 63.1 | 116.1 |

It is readily apparent from the above that the products of this invention can be diluted with or premixed with pigment type fillers of small particle size without loss of effectiveness in the ability of the additive to give good gloss to a calendered coated paper. Further, that an additive coated pigment is a very efficient gloss improver and that the less phosphate ester additive (20% less in this example) gives an equal degree of gloss.

EXAMPLE 15

In a similar manner, the phosphate esters of stearyl alcohol were prepared in one case (A) using $P_2O_5$ (54.4 g.) with 300 g. of Alfol 18 (Continental Oil Co.) and in the other (B) using 128.2 g. of 115% polyphosphoric acid. The mixture was heated to 110°–115° C. for 3½ hours and 1 hour respectively.

The products were titrated to determine their equivalent weights which were 290 and 181 respectively; (Alfol 18 has a hydroxyl number of 302), then were neutralized with a mixture of calcium hydroxide and 5.5% of Neodol 25-9, a nonionic emulsifier as a 40% dispersion in water.

These additives were put into a paper coating formulation as shown in Example 14 and tested as in the previous example. The gloss readings with the No. 40 Mayer rod were 68.6 and 60.4 respectively.

EXAMPLE 16

A coating formula was prepared as follows:

| | |
|---|---|
| 400 g | Ultragloss 90 Clay |
| 70 g | Stayco M Starch |
| 0.8 g | Calgon |
| 1154 g | Water |
| 1.6 g | 50% NaOH |

The mixture was heated to 95° C. with steam and held 15 minutes. Vigorous agitation, of course, was needed to assure blending and heat transfer. The coating batch was split into three equal portions which were blended respectively with A (a commercial 50% calcium stearate dispersion as sold and used in paper coatings), B (the product of Example 13), and C (the phosphate ester of Example 13 neutralized with potassium hydroxide at 40% solids in water) at 1% solids on the pigment. Publication coating stock was blade coated on one side, air dried, oven dried, and equilibriated to 50% RH before calendering. The coat weights were 14–15 lbs./3300 ft.$^2$.

| | Paper Gloss Number of Nips | | | | |
|---|---|---|---|---|---|
| Lubricant 1% | 0 | 1 | 2 | 4 | 6 |
| A | 14.6 | 56.2 | 64.1 | 72.0 | 74.8 |
| B | 14.6 | 53.8 | 64.6 | 69.3 | 72.7 |
| C | 14.7 | 57.1 | 66.0 | 71.5 | 74.3 |

EXAMPLE 17

The calcium salt of the phosphate ester of Alfol $C_{20}$+ as prepared in Example 13 at a 40% solids level was mixed by simple stirring with a 70% in water dispersion of paper coating clay (Anglo American). The ratio's were

| | g's 100% | g's as is |
|---|---|---|
| Gloss Improver (phosphate ester of Example 13) | 56.0 g. | 140.0 g. |
| Paper coating clay | 56.0 g. | 79.6 g. |
| | 112.0 g. | 219.6 g. |

The mixture was 51.0% solids. It was put through a laboratory Logeman Homogenizer to thoroughly coat the clay with the gloss improver. There was no increase in viscosity and the highly sheared mixture remained fluid and stable.

It was then added at a level of 1.0 parts (solids basis or 0.5 parts of the gloss improver) to a paper coating formulation consisting of: (all numbers are dry solids).

100 parts of KCS clay (a typical refined, high brightness clay)
0.25 parts tetra sodium pyrophosphate
0.10 parts NaOH
20.0 parts Stayco M (an oxidized starch manufactured and sold by A. E. Stanley)
1.0 parts Gloss Improver The second paper coating formulation was prepared using 1 part (solids basis) per 100 parts of clay of the phosphate ester salt only.

The coatings were separately applied to 40 lbs. basis paper coating stock using a Mayer rod. The coated sheets were dried and calendered at 500 pli, 3 nips and the gloss results were found to be equal.

The following examples illustrate the advantages of the invention as measured in terms of the thixotropic properties of the improved coating formulation.

EXAMPLE 18

A paper coating formulation was prepared with the following composition:

| Parts 100% | Grams as is Basis | |
|---|---|---|
| 100 | 428.6 g. | J. M. Huber's Hydrosperse #2 (70% solids) |
| 13 | 39 g. | Borden's Casein PCB |
| 2.3 | 7.8 g. | Ammonia 30% |
| 21 | 46.7 g. | Dow 620 Latex (45% solids) |
| 129.2 | 377.7 g. | water |

-continued

| Parts 100% | Grams as is Basis |
|---|---|
| | 899.8 g. |

To which was added 1 part (solids basis) of a gloss improver additive (described below) per 100 parts of clay solids and the whole mixed in a high shear blender. The viscosities of the coating formulations were determined in a Fann viscocometer which can determine viscosities over a wide range of shear rates. The viscosity was recorded when taken at 3 RPM after the coating had been stirred for 1 minute at 300 RPM (this viscosity is called gel strength). This is compared with the so called plastic viscosity which is the difference between viscosities at 300 and 600 RPM.

The former represents the tendency of the coating to build thickness and to maintain a level surface after the coating has passed under or through the high shear region of the air-knife or whatever leveling mechanical device is used to reduce the coating, to the desired thickness during the coating operation. If the "gel strength" or viscosity at very low shear rates is too low, the coating will, in the time between leaving the region of the knife coater and when it is dry and set in the region of the dryer, tend to flow into a pattern of conformation with the relativity rough paper substrate. Thus, a high gel strength is desirable.

At the same time, it is desirable to maintain a low or at least not an excessive "plastic viscosity". This viscosity function, which is in effect the slope of the viscosity-shear rate curve (or as formalized here the difference between the viscosity at 600 and 300 RPM converted to centipoise units by the numbering system of the Fann viscocimeter used to make the measurements), is a measure of the spreading or coating action of the blade ("trailing blade") or air knife as it removes excess coating from the paper. Plastic viscosity is directly related to the ability of the knife or blade to generate a smooth coating (the higher the plastic viscosity, the poorer the action of the knife).

The calcium salts of the phosphate esters of this invention are particularly suitable in this regard and may in fact, be used at relatively high levels in a styrene-butadiene latex to give high gel strengths without an undo increase in the plastic viscosity. Thus, in the coating formulation shown above at a level of 1% additive on the weight of the clay pigment, the following gel strengths and plastic viscosities were found:

| | Dow 620 Latex-Casein | | | |
|---|---|---|---|---|
| | 1% Additive: Phosphate ester of | Gel Strength | Plastic Viscosity | pH |
| (I-6-113) | Epal 1418 Ca Salt (mixed 14, 16, 18 straight chain alcohols) | 11 | 55 | 9.2 |
| (I-6-24) | Example 13 | 7 | 51 | 9.3 |
| I(-3-)-111 | Na isooctyl alcohol Phosphate ester | 4 | 53 | 9.3 |
| Calcium Stearate | | 4 | 56 | 9.5 |

EXAMPLE 19

In the same coating formulation but with higher levels of additives such that the plastic viscosity was approximately 37–53, the gel strength of the coating formulations containing phosphate esters or gloss improvers were significantly higher than that of the commonly used calcium stearate.

VISCOSITY of PAPER COATING FORMULATIONS: PROTEIN, STYRENE-BUTADIENE, CLAY

| | Additive | Concentration (100% active additive on weight of the clay) | Gel Strength | Plastic Viscosity |
|---|---|---|---|---|
| PC-87-E | Calcium Stearate | 2.5% | 2.5 | 48 |
| PC-87-A | Calcium Salt of Phosphate ester of Epal $C_{20}$ | 5.0% | 6.0 | 47 |
| PC-87-B | Ca salt of phosphate ester of Alfol 18 (stearyl alcohol) | 1.6% | 14 | 49 |
| PC-87-E | calcium salt of phosphate ester of Alfol $C_{20}$ | 5.0% | 17 | 53 |
| PC-87-C | Calcium salt of phosphate ester of Alfol 1418 (A $C_{14}$, $C_{16}$, $C_{18}$ blend of straight chain alcohols.) | 5% | 5 | 37 |

EXAMPLE 20

In a similar manner, starch-clay paper coating formulations were prepared using the following clay-starch formulation; (This is only one of many possible clay-starch formulations. The variations in clays, starches, and the inclusion of other binders and pigments are variations well known to those skilled in the art.)

| Parts-solids Basis | |
|---|---|
| 100.6 | Huber Hydrasperse #2 70% dispersion |
| 0.25 | tetrapotassium pyrophosphate |
| 0.10 | Sodium hydroxide |
| 20.0 | Dry-Flo 49–4951, a paper coating starch from National Starch, Inc. |
| 1.0 | Additive (solids basis) (or as indicated) |
| 124.5 | Water |

The viscosities found were:

| | Additive | concentration (100% active additive on weight of of clay) | Gel Strength | Plastic Viscosity |
|---|---|---|---|---|
| (1-6-83) | Calcium salt of phosphate ester of Stearyl alcohol | 0.4% | 2 | 25 |
| | Calcium salt of PE of Alfol $C_{20}$ | 1.0% | 1.5 | 21 |
| | Calcium salt of PE of Epal $C_{20}$ | 1.0 | 1.5 | 18.5 |
| Calcium salt of PE of | 1.0 $C_{14}$, $C_{16}$, $C_{18}$ fatty alcohols | 1.5 | 23.0 | |

-continued

| | Additive | concentration (100% active additive on weight of of clay) | Gel Strength | Plastic Viscosity |
|---|---|---|---|---|
| Calcium stearate | 1.0 | 1.0 | 20.0 | |

And at higher concentrations of additive in the same clay-starch coating, the following viscosity were observed indicating that the gloss improver additives of this invention have a pronounced tendency to improve the ratio of gel strength to plastic viscosity.

| Additive | % | Gel Strength | Plastic Viscosity |
|---|---|---|---|
| Phosphate ester of Epal $C_{20}$ | 5.0 | 18 | 58 |
| PE of Alfol 18 (stearyl alcohol) | 3.2 | 86 | 50 |
| PE of Epal 1418 ($C_{14}$, $C_{16}$, $C_{18}$ | 5 | 38 | 18.5 |
| PE of Alfol $C_{20}$ | 5 | 58 | 82 |
| calcium stearate | 2.5 | 3 | 35 |

While the invention has been described hereinabove in various specific embodiments and examples, it will be understood that this has been done to illustrate the invention and that the invention is not limited thereto but its scope is to be determined by reference to the following claims. It will be apparent to those skilled in the art that numerous modifications in the practice of the invention may be made without departing from the scope of the invention as set forth in the claims.

What is claimed is:

1. A composition for coating paper and suitable for producing a paper surface which can be polished (calendered) to a higher level of gloss consisting essentially of; (A) 100 parts of a uniformly fine mesh kaolin clay pigment of paper coating grade having less than 0.05% particles greater than 325 mesh; (B) 5 to 30 parts of a binder taken from the group consisting of (a) 0 to 30 parts starch, oxidized starch, enzyme converted starch, hydroxyethylated starch, hydroxypropylated starch, and starch derivatives (b) from 0 to 14 parts of a synthetic latex binder taken from the group consisting of polymers and copolymers of styrene, butadiene, ethylene, propylene, vinylacetate, esters of acrylic and methacrylic acid and copolymers and terpolymers of these monomers with vinyl carboxylic acids having the structure $$-\underset{|}{C}=\underset{|}{C}-COOH$$

(c) 0 to 10 parts of water soluble polymers taken from the group consisting of polyvinyl alcohol, protein, hydrolyzed protein, copolymers of maleic anhydride with butadiene, styrene, methyl vinyl ether and ethylene, polyacrylic acid, polymethacrylic acid; and water soluble copolymers of vinyl carboxylic acids having the structure $$-\underset{|}{C}=\underset{|}{C}-COOH;$$

(C) from 0.3 to 20 parts of a gloss improver taken from the group comprising phosphate esters of aliphatic alcohols of carbon number 16 to 26; and uniformly dispersed in 35 to 95% water.

2. A composition according to claim 1 in which (B) is;
(a) 5–30 parts
(b) 0–14 parts
(c) 0–10 parts.

3. A composition according to claim 1 in which (B) is;
(a) 0 parts
(b) 5–14 parts
(c) 0–10 parts.

4. A composition according to claim 1 in which (C) is; 0.3 to 20 parts of an acid phosphate ester having the structure $$R-O_x-\overset{\overset{\displaystyle O}{\|}}{P}-(OM)_y$$

in which $x+y=3$, $R=C_{16}$ to $C_{26}$, M is ammonia, alkanolamine, alkalie metal and alkaine earth metal; and which contains from 3% to 95% of said phosphate ester of a dispersing agent-stabilizer surfactant taken from the group consisting of:

RX where R is a hydrocarbon hydrophobic moiety of 10 to 26 carbon atoms and X is a water soluble moiety selected from the group consisting of $OSO_3M$, $SO_3M$, COOM; and M is ammonia, alkanol amine, and the alkalie and alkaline earth metals;

RAX where R is as above; A is a polyethenoxy moiety; and X is selected from the group consisting of —$OSO_3M$,—$SO_3M$, —COOM, and $$-O)_x-\overset{\overset{\displaystyle O}{\|}}{P}-(OM)_y$$

where $x+y=3$;

RAH where A is a polyethenoxy moiety and is 60 to 95% by weight of the surfactant;

HABAH where B is a polyoxypropylene moiety of 100 to 4000 MW and A is a polyoxyethylene moiety and is 10 to 90% by weight of the surfactant.

5. A composition according to claim 1 in which (C) is a phosphate (acid) ester of a $C_{16}$ to $C_{26}$ alcohol in admixture with up to an equal weight of a phosphate (acid) ester of a $C_6$ to $C_{14}$ alcohol and their ammonia, alkanolamine, alkalie or alkaline earth metal salts.

6. A composition as in claim 1 in which said gloss improver (C) contains up to 45% of a high boiling hydrocarbon.

7. A composition according to claim 1 in which said phosphate ester is derived from polyphosphoric acid.

8. A substantially homogenous stable aqueous suspension of finely divided particles suitable for use as a gloss improver in paper coatings which are to be polished (calendered) to a higher degree of gloss consisting essentially of, by weight; (A) acid phosphate esters and their partial or complete salts of ammonia, alkanol amines, alkalie metals or alkaline earth metals of $C_{16}$ to $C_{26}$ alcohols, and (B) a surfactant taken from the group consisting of;

RX where R is a hydrocarbon hydrophobic moiety of $C_{10}$ to $C_{26}$ and X is a water soluble anionic moiety selected from the group consisting of $OSO_3M$, $SO_3M$, COOM, and M is ammonia, alkanol amine, the alkalie or alkaline earth metals, RAX where R is as above, A is a polyethenoxy moiety, and X is taken from the group consisting of —$OSO_3M$,$SO_3M$, $$-O)_x-\overset{\overset{\displaystyle O}{\|}}{P}-(OM)_y$$

where $x+y=3$, and M is as above,

RAH where A is a polyethenoxy moiety and is 60 to 95% by weight of the surfactant, and HABAH where B is a polyoxypropylene moiety of 100 to 4,000 MW and A is a polyoxyethylene moiety and is 10 to 90% by weight of the surfactant; and the ratio of phosphate ester to other surfactant is 97:3 to 1:1; and about 70% to 45% water.

9. A composition according to claim 8 in which said phosphate ester (A) comprises 100 parts, said surfactant (B) comprises 3 to 10 parts; and which is intimately mixed with (C) about 20 to 100 parts of a finely divided paper coating pigment having no more than 0.05% particles greater than 325 mesh; and 45 to 70% water.

10. A composition according to claim 9 in which said paper coating pigment is paper coating grade kaolin.

11. A composition according to claim 10 in which said phosphate ester (A) is a mixture of a phosphate ester of a $C_{20}$ to $C_{26}$ alcohol and up to 45 parts of a high boiling hydrocarbon.

12. The composition as in claim 9 in which (a) the phosphate ester is derived from polyphosphoric acid.

13. A composition suitable for use as a gloss improver and lubricant in calendered paper coatings consisting essentially of a mixture of 50 to 95 parts of a $C_{16}$ to $C_{26}$ alkyl (acid) phosphate ester and its alkanol amine, ammonia, alkalie metal and alkaline earth metal salts and 5 to 50 parts of a $C_6$ to $C_{14}$ alkylacid phosphate ester and its alkanolamine, ammonia, alkalie metal salts and which is an aqueous dispersion in 45 to 80% water.

* * * * *